United States Patent [19]

Thomas

[11] 4,075,795

[45] Feb. 28, 1978

[54] THEATER STRUCTURE

[76] Inventor: Anthony Thomas, 104 N. Ninth Ave., Coatesville, Pa. 19320

[21] Appl. No.: 730,562

[22] Filed: Oct. 7, 1976

[51] Int. Cl.[2] ..... E04H 14/00

[52] U.S. Cl. ..... 52/8; 52/67; 52/80

[58] Field of Search ..... 52/6-10, 52/67, 68, 80, 82, 174; D25/12, 19, 3; 350/124, 117

[56] References Cited

U.S. PATENT DOCUMENTS

| | | | |
|---|---|---|---|
| 1,437,946 | 12/1922 | Miller | 52/8 |
| 1,909,537 | 5/1933 | Hollingshead, Jr. | 52/6 |
| 2,831,217 | 4/1958 | Lombardo | 52/6 |
| 3,168,761 | 2/1965 | Graf | 52/9 |
| 3,422,581 | 1/1969 | Allen | 52/6 |
| 3,494,655 | 2/1970 | Linton | 52/67 X |
| 3,545,143 | 12/1970 | Bankston | 52/6 |
| 3,668,810 | 6/1972 | Bankston | 52/6 |

FOREIGN PATENT DOCUMENTS

| | | | |
|---|---|---|---|
| 566,844 | 12/1932 | Germany | 52/67 |
| 411,749 | 4/1922 | Germany | 52/6 |
| 1,124,724 | 2/1960 | Germany | 350/117 |
| 2,255,393 | 5/1974 | Germany | 52/67 |
| 1,123,791 | 8/1968 | United Kingdom | 52/67 |

OTHER PUBLICATIONS

"Umbrella Theater" Popular Mechanics, May 1950, pp. 132, 133.

Architectural Record, May 1959, "Retractable Dome for All-Weather Arena" pp. 250, 251.

Architectural Record, Dec. 1952, pp. 121-125, Charlotte Civic Center.

*Primary Examiner*—Leslie Braun

*Attorney, Agent, or Firm*—Michael F. Petock

[57] ABSTRACT

A theater structure is disclosed in which partons may view a live production on stage or a moving picture from the seats of their automobiles or from seats provided within the theater. The theater is also provided with a restaurant facility. Performances, either live or in the form of moving pictures, may be given at any time, during night or daylight hours and during clear and inclement weather. The theater is provided with an openable roof structure which enables the theater to be opened to the open air during clear nights. However, the theater may be closed during the day for the showing of moving pictures and it may also be closed during inclement weather conditions.

8 Claims, 6 Drawing Figures

FIG.3
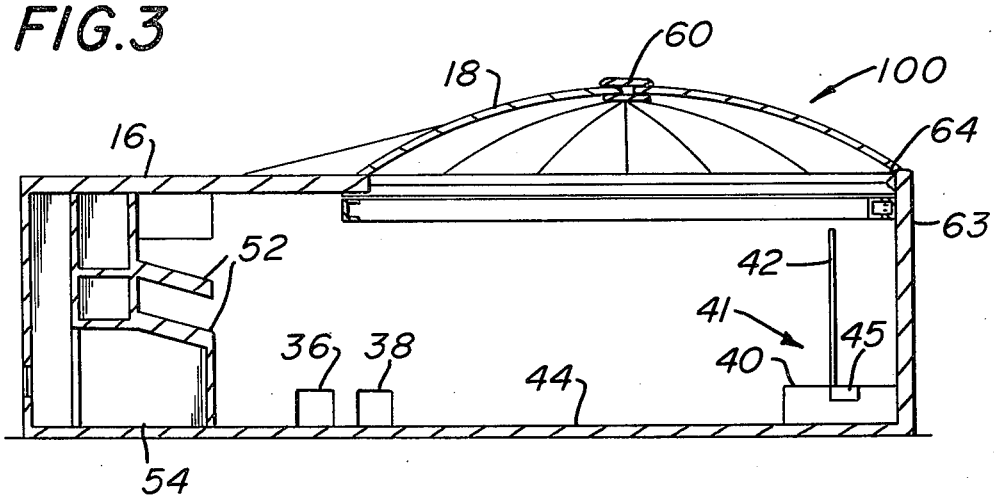
FIG.5
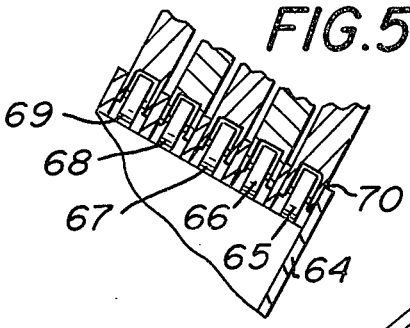
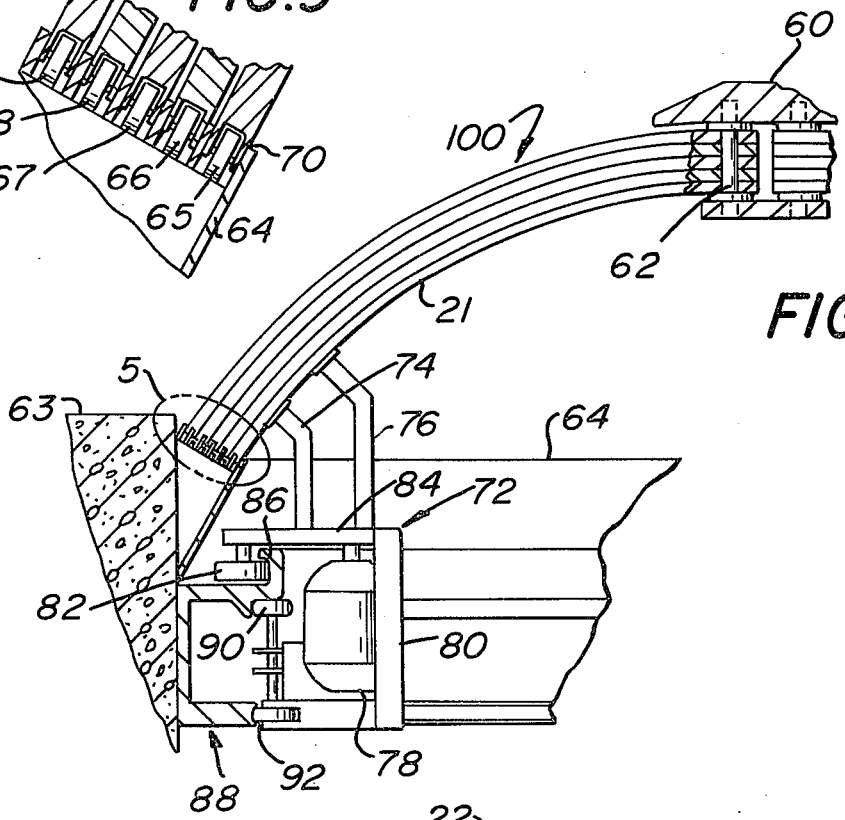
FIG.4
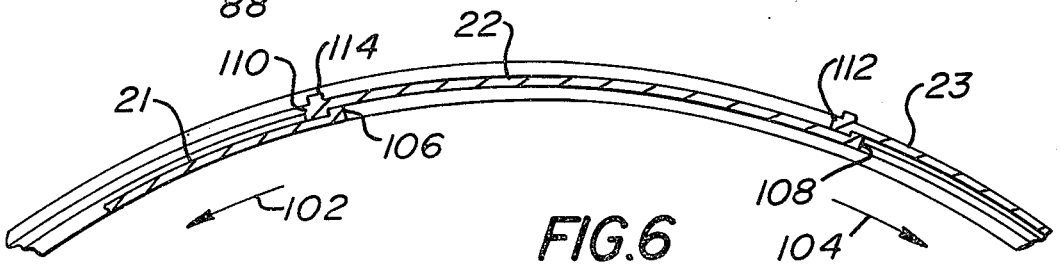
FIG.6

THEATER STRUCTURE

BACKGROUND OF THE INVENTION

The present invention relates to a theater structure. More particularly, the present invention relates to a theater structure which may be used as an indoor or open air theater and which may be used as a drive-in theater during daylight hours and/or inclement weather.

Most drive-in theaters at present are of the type in which a screen is provided in an outdoor area. The vehicles park in an open area in front of the screen wherein persons located in the vehicle may watch the moving picture. However, the theater may not be used during the daylight hours as the light interferes with the viewing of moving picture. Also, the movie theater may not be used during inclement weather, and conditions such as fog, smoke or dust interfere with the viewing of the picture. Furthermore, during the winter months, individual car heaters must be provided or the patrons of the theater must keep their automobiles running with the automobile heaters operating. In accordance with the present invention, temprature and other conditions within the theater may be regulated.

Applicant has become aware of U.S. Pat. No. 3,422,581—Allen which is directed to a dome-type drive-in theater. The Allen patent discloses a dome-shaped drive-in theater which would shield the viewing patrons from daylight and/or inclement weather. However, the Allen patent does not disclose an openable dome which would allow the patrons to have an open air theater on clear nights. Furthermore, the Allen patent is not directed to a combination live performance stage and movie theater in which patrons may sit in seats or in their parked automobiles, also having access to a restaurant.

SUMMARY OF THE INVENTION

An advantage of the present invention is that drive-in theater patrons may enjoy a live performance or a movie during the daylight hours and/or during inclement weather.

A still further advantage of the present invention is that drive-in theater patrons may enjoy an open air theater during fair weather nights.

A further advantage of the present invention is that the dome of the theater is selectably openable and closable.

A still further advantage of the present invention is that patrons may sit in their parked automobiles or they may sit in individual seats provided in the theater.

A still further advantage of the present invention is that it provides restaurant services.

Briefly, in accordance with the present invention, there is provided a theater structure comprised of a building provided with a driveway entrance for automobiles. A stage is located at one end of the building with a retractable screen. An area is provided in front of the stage and retractable screen for parking a plurality of automobiles whereby persons within the automobiles may view performances on the stage or moving pictures on the screen. An openable dome structure is provided for covering the automobile parking area which may be closed to keep out light and/or inclement weather and which may be opened during ambient darkness and fair weather conditions. A plurality of seats is provided in front of the stage and screen and behind the automobile parking area for persons to sit and view the performances on the stage or moving pictures on the screen.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 3 is a cross sectional elevational view taken along 3—3 of FIG. 2.

FIG. 4 is an end view of the motor driven dome panels.

FIG. 5 is a cross sectional exploded view of area 5 of FIG. 4.

FIG. 6 is a cross sectional view of several dome panels taken in an extended position.

DETAILED DESCRIPTION OF THE PREFERRED EMBODIMENT

Figure 1:
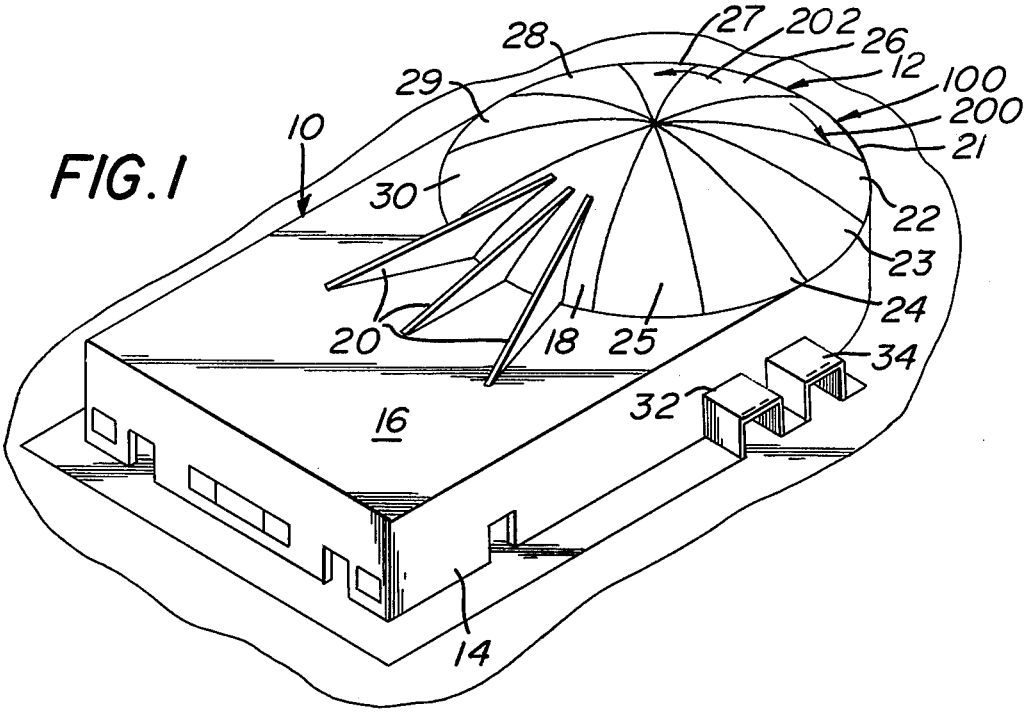
FIG. 1 is a view in perspective of a theater structure in accordance with the present invention.

Referring now to the drawings in detail wherein like numerals indicate like elements, there is shown in FIG. 1 a theater structure 10 provided with an openable dome structure 12. The theater structure 10 is comprised of a building 14 having a roof 16. The openable dome structure is provided with a stationary segment 18 supported by ribs 20. The openable portion of the dome is comprised of a plurality of motor driven dome panels or segments 100. Dome panels or segments 21, 22, 23, 24, and 25 telescope in the direction of arrow 200 under stationary segment 18 when the openable dome roof 12 is opened. Telescoping segments 26, 27, 28, 29 and 30 telescope in the direction of arrow 202 under stationary segment 18 when openable dome structure 12 is opened.

Figure 2:
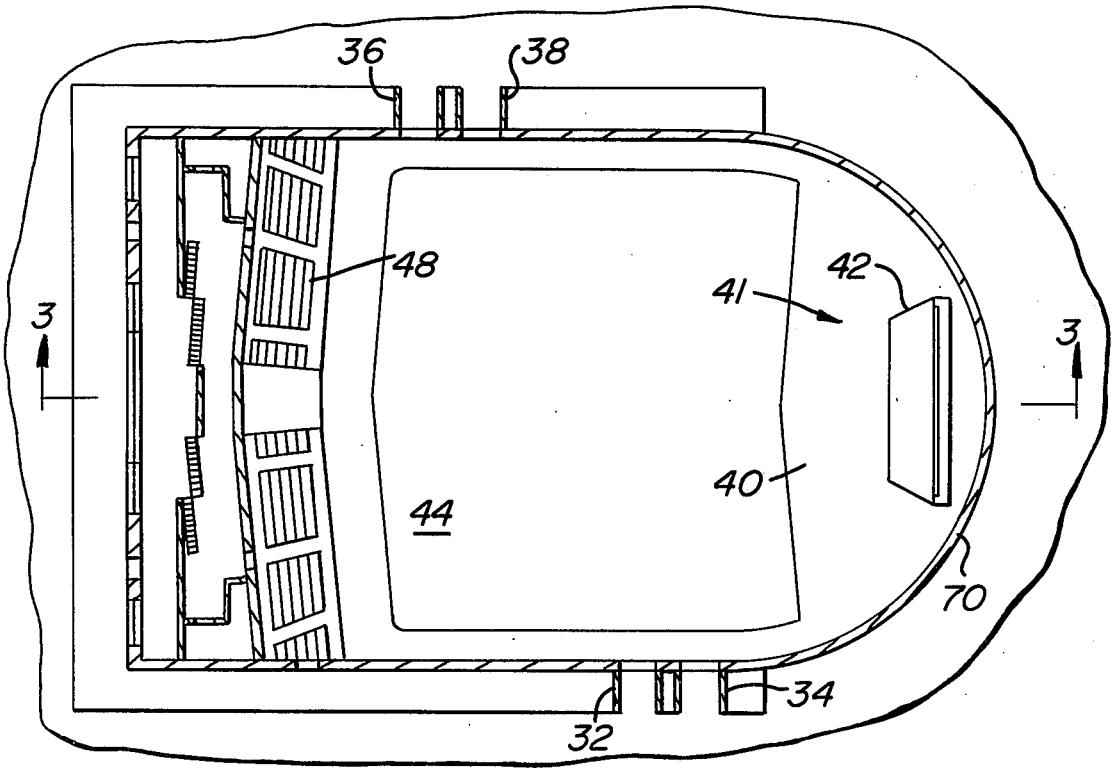
FIG. 2 is a plan view of the theater structure of FIG. 1.

Referring now to FIGS. 2 and 3 taken in conjunction with FIG. 1, there are shown automobile passageways 32, 34, 36 and 38 for the entrance and exit of automobiles. Passageways 32, 34, 36 and 38 allow the passage of automobiles into and out of the drive-in theater without allowing an excessive amount of light into the theater during daylight hours.

Inside of the theater, a performance viewing area 41 is provided which includes a stage 40 for live performances. A retractable screen 42 having a retraction means 45 is provided on state 40. An area 44 is provided in front of the performance viewing area 41, which includes stage 40 and screen 42, for the parking of automobiles in which patrons of the theater may sit to view live performances on state 40 or moving pictures on retractable screen 42. Seats 48 are provided in balconies 52. Seats 48 are located in front of performance viewing area 41 and behind the automobile parking area 44. Seats 48 are provided for patrons who wish to sit in individual seats rather than in parked automobiles. These may be patrons who have parked their automobiles outside or they may be patrons who have parked their automobiles in the automobile parking area 44. Restaurant facilities and/or other shops are also provided in area 54 below seats 48.

As may be seen from FIG. 3, seats 48 in balconies 52 are provided under the unopenable substantially flat portion of roof 16 and the automobile parking area 44 is under the openable dome structure.

Referring now in more detail to FIGS. 4, 5 and 6, there is shown in more detail the openable roof structure comprised of dome panels or segments 100. Each dome panel or segment is comprised of a quasi-rectangular spherical section. The dome panels or segments 100 are pivotally mounted at the apex 60 of the dome structure by means of bearing pin 62. As may be seen more clearly in FIG. 4, the opposite ends of dome panel members 100 ride in a track means 64 comprised of a plurality of tracks. The track means 64 is mounted to wall 63 of building 14.

As may be more clearly seen from the exploded view of FIG. 5, track means 64 is comprised of individual tracks 65 through 69 with an individual track being provided for each of the dome panel members 100. The ends of dome panel members 100 are provided with rollers 70 in order to reduce friction. The innermost panel 100, in other words the panel riding in track 65, is provided with a motor drive means 72. The innermost panel to which the motor drive means 72 is attached would be dome panels 21 and 26, referring to FIG. 1. For the purposes of a concrete illustration, the inside panel showing in FIG. 4 will be number 21. However, it is understood that the motor means attached to panel 26 is identical.

Motor drive means 72 is attached to dome panel 21 by means of rigid support members 74 and 76. Motor drive means 72 is comprised of a reversible bi-directional electric motor 78 mounted in a motor support frame 80. Motor 78 drives drive wheel 82 via suitable mechanical linkage contained within member 84. Drive wheel 82 engages a track 86 of drive track means 88. Guide wheels 90 and 92 are mounted on motor frame 80 and engage racks on drive track means 88.

Referring now to FIG. 6, there is shown in cross section all or part of three dome panels which are numbered 21, 22 and 23. FIG. 6 illustrates projecting interlocking elements located along the longitudinal ends of the dome panels. The rear longitudinal end of dome panel 21 is provided with a projecting interlocking element 106 and the rear longitudinal end of dome panel 22 is provided with a projecting interlocking element 108. When panel 21 is drawn in the direction of arrow 102 by means of motor 78 operating in a first direction, panel 21 is driven in the direction of arrow 102. The projecting interlocking element 106 engages the projecting interlocking element 110 on dome panel 22 causing panel 22 to also be drawn in the direction of arrow 102. Similarly, as dome panel 22 is drawn in the direction of arrow 102, projecting interlocking element 108 engages projecting interlocking element 112 of dome panel 23, causing dome panel 23 to also be drawn in the direction of arrow 102.

When it is desired to retract the dome panels or in other words open the dome roof, motor 78 is operated in the reverse direction causing wheel 82 to operate in the opposite direction and move the motor 78, motor frame 80 and panel 21 in the direction of arrow 104. A projecting element (not shown) on dome panel 21 engages projecting interlocking element 110 driving panel 22 in the direction of arrow 104. Projecting element 114 on dome panel 22 then engages projecting element 112 on dome panel 23 causing dome panel 23 to be driven in the direction of arrow 104. The openable dome panel roof structure operates in this manner for all of the panels on both sets of dome panels to cause them to be drawn out and retracted as weather conditions require.

Suitable ventilation and comfort control systems, such as air conditioning, heating and air cleaning systems, are provided in the building to maintain a desired temperature and to purify or clean the air when the roof 12 is closed. The air cleaning and purifying means includes means to remove carbon monoxide and other fumes generated by exhausts of the gasoline motors of the automobiles.

The present invention may be embodied in other specific forms without departing from the spirit or essential attributes thereof, and, accordingly, reference should be made to the appended claims, rather than to the foregoing specification as indicating the scope of the invention.

I claim:

1. A theater structure, comprising:

a building provided with a driveway entrance for automobiles and a roof structure having a substantially flat portion and an openable dome structure;

a performance viewing area located at one end of the building;

an area in front of said performance viewing area for parking a plurality of automobiles whereby persons within said automobiles may view performances;

said openable dome structrue covering said automobile parking area which may be closed to keep out light and/or inclement weather and which may be opened during ambient darkness and fair weather conditions; and a plurality of seats in front of said performance viewing area and behind said automobile parking area for persons to sit and view performances, said plurality of seats being under said substantially flat portion of said roof structure.

2. A theater structure in accordance with claim 1 including a restaurant located behind and below said plurality of seats.

3. A theater structure in accordance with claim 1 wherein said performance viewing area includes a stage usable for live performances.

4. A theater structure in accordance with claim 3 wherein said stage is provided with a retractable screen, said screen being usable for the projection of moving pictures thereon.

5. A theater structure in accordance with claim 1 wherein said openable dome structure is comprised of a plurality of panels pivoted at a point located substantially at the apex of said dome structure, the opposite ends of said panels riding in tracks mounted to said building walls.

6. A theater structure in accodance with claim 5 in which at least one of said panels is driven by an electric motor, said electric motor being connected to said panel and being operable to rotate a drive wheel mounted in a drive track.

7. A theater structure in accordance with claim 5 in which longitudinal edges of said dome panels are provided with projecting interlocking elements.

8. A theater structure in accordance with claim 6 in which said electric motor is a bi-directional electric motor, said electric motor being operable to rotate said drive wheel in either of two directions.

* * * * *